United States Patent [19]

Jung

[11] Patent Number: 4,986,788

[45] Date of Patent: Jan. 22, 1991

[54] PROCESS OF FORMING AN IMPREGNATED CATHODE

[75] Inventor: Jongin Jung, Kyungi, Rep. of Korea

[73] Assignee: Samsung Electron Devices Co., Ltd., Kyungki, Rep. of Korea

[21] Appl. No.: 431,381

[22] Filed: Nov. 2, 1989

[51] Int. Cl.[5] ..... H01J 9/04

[52] U.S. Cl. ..... 445/50; 427/77; 427/348

[58] Field of Search ..... 427/77, 348; 445/50, 445/51

[56] References Cited

U.S. PATENT DOCUMENTS

| | | | |
|---|---|---|---|
| 4,379,979 | 4/1983 | Thomas et al. | 445/50 |
| 4,835,052 | 5/1989 | Yamamoto | 427/348 X |
| 4,894,257 | 1/1990 | Smith et al. | 445/50 X |

*Primary Examiner*—Kenneth J. Ramsey

[57] ABSTRACT

A cathode and a process of manufacturing the same are disclosed, the cathode comprising; a molybdenum cup having a convex portion, free barium atoms produced through reactions with an impregnation compound, a porous metal layer sealingly welded to the top of the cup, and a heating member having an uppermost head portion inserted into the lower space of the convex portion of the cup. According to the cathode of the present invention, the disadvantages of the conventional cathodes such as the speedy evaporation of barium during the initial stage, and the degrading of the performance and the shortening of the life expectancy due to the reaction byproducts produced in the porous metal layer can be overcome, while a quick start-up characteristics can also be obtained owing to the speedy diffusion of the barium.

6 Claims, 3 Drawing Sheets

PROCESS OF FORMING AN IMPREGNATED CATHODE

BACKGROUND OF THE INVENTION

The present invention relates to a cathode for use in an electron tube and a process of manufacturing the same.

The cathode for electron tube in a cathode ray tube is manufactured in such a manner that a tricarbonate containing barium as the principal ingredient is contained in a metal cup as of nickel with a transverse plate, anf then, it is subjected to an oxidation process.

Meanwhile, the resolution for the image of a cathode ray tube depends on the size of the diameter of the electron beams emmitted from the electron gun, and therefore, the smaller the diameter of the electron beams, the clearer the image on the screen. However, if a clear image is to be produced, the current density of the cathode should be very high.

However, the current density released through the cathode of the conventional tube is no more than 1 A square centimeter, this level of current density being far insufficient to obtain a high resolution.

Coming recently, efforts have been focused on high quality televisions, and to meet this trend, several methods have been proposed.

A typical example of them is illustrated in FIG. 4A, which consists of two types: one of them being a dispenser type constituted such that barium carbonate 12 filled into a cup 11 as of molydenum cup A is clad with a porous metal layer 13 in such a manner that thermal electrons should be released through the porous metal layer 13; and another one of them being an impregnation type constituted such that only a porous metal layer 13 is filled into said cup 11, and this is impregnated with a compound containing barium oxide (BaO), aluminum oxide (Al2O3) and calcium oxide (CaO).

Another example is illustrated in FIG. 4B, which is constituted such that an impregnated metal layer 14 formed by impregnating an impression compound into the porous metal layer 13 is disposed in the cup 11, and a porous metal layer 13 is clad upon the top of it, thus formimg a space division. In this type, there arises the problem that it is difficult to control the thickness of the impregnated metal layer 14 when fabricated and therefore, this has not been commercialized yet.

The improved cathodes as above described have the advantage that, when the current density is increased with regard to the heating of the carbonate, the evaporation loss of the barium due to the joule heating can be inhibited, thereby assuring a sufficient life expectancy of the cathode. However, due to the fact that pores are formed in the upper porous metal layer, the initial activation period is extended, that is, the time until the thermal electron release materials are diffused from the lower portion to the upper portion is extended, thereby giving the disadvantage that a quick start-up characteristics is deficient. Further, the porous metal layer contains usually tungsten as the principal ingredient, and therefore, if thermal electron release materials such as barium oxide by product, then there arises the problem that a reaction by-product defined by the following formula is created;

$$W + 3Ba_3Al_2O_6 + 6CaO \rightarrow 3Ba_2CaAl_2O_6 + 3Ba + Ca_3WO_6 \quad (1)$$

The reaction by-product can be filled in the pores of the porous metal layer, and through the accumulation of this phenomenon, the diffusion velocity of the thermal electrons can be more and more lowered.

Therefore, according to the most recent trend, the efforts are focused on cladding iridium, osmium. rhenium and the like on the porous metal layer, or developing impregnation compound, but no satisfactory result has been seen yet.

SUMMARY OF THE INVENTION

The present invention is intended to overcome the disadvantages of the improved conventional cathodes as above described.

Therefore it is the object of the present invention to provide a cathode for electron tube and a process of manufacturing the same, in which a high current density is provided, and a quick start-up characteristics is realized.

In achieving the above object, the manufacturing method of the present invention comprises; a first step of filling a powdered reduction into a cup as of molybdenum in the volume of 10–100% as against the total capacity of the cup, and sealing the top of the cup with a porous metal layer by welding; a second step of impregnating a melted impregnation compound into the reduction agent filled in the impregnation tank under a vacuum atmosphere so as for the barium to be reduced; and a third step of injecting an inert gas through the upper porous metal layer so as for the closed pores to be opened.

In the above described process, the porous metal layer is made of a sintered tungsten having a porosity of 10–40%, or a sintered tungsten containing any one or more of nickel, steel and cobalt in the amount of 0.05–10 wt%, while the reduction agent consists of a composition containing a 99% pure or purer tungsten powder in the amount of 80–100 wt%, silicon powder in the amount of 0–20 wt%, and magnesium powder in the amount of 0–20 wt%, the average particles of the powders being 1–20 μm.

In the case of the abovementioned sintered tungsten, if the content of the tungsten element exceed 10 wt%, then the reducing efficiency is lowered, while if the content is below 0.05 wt%, the sintering temperature is too highly elevated. Normally, the sintering temperature of pure tungsten is 2000° C., while the sintering temperature of the tungsten according to the method of the present invention falls within the range of 1200°–1500° C.

As the impregnation compound, the ordinary type containing barium oxide, calcium oxide and aluminum oxide in proper amounts can be used, and a specific example is shown in the table below.

TABLE

| | | (Mole ratio/wt %) | |
|---|---|---|---|
| Classification | Barium oxide | Calcium oxide | Aluminum oxide |
| A | 4/79.5 | 1/7.3 | 1/13.2 |
| B | 3/74.4 | 1/9.1 | 2/17.9 |
| C | 5/67.3 | 3/14.8 | 2/17.9 |

The main feature of the cathode according to the present invention is that a convex portion is provided at the bottom of the cup, and the upper portion of the heater member is disposed within the convex portion in such manner that the thermal conduction to the thermal electron release material should be speedily carried out.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE INVENTION

First step

Figure 1:
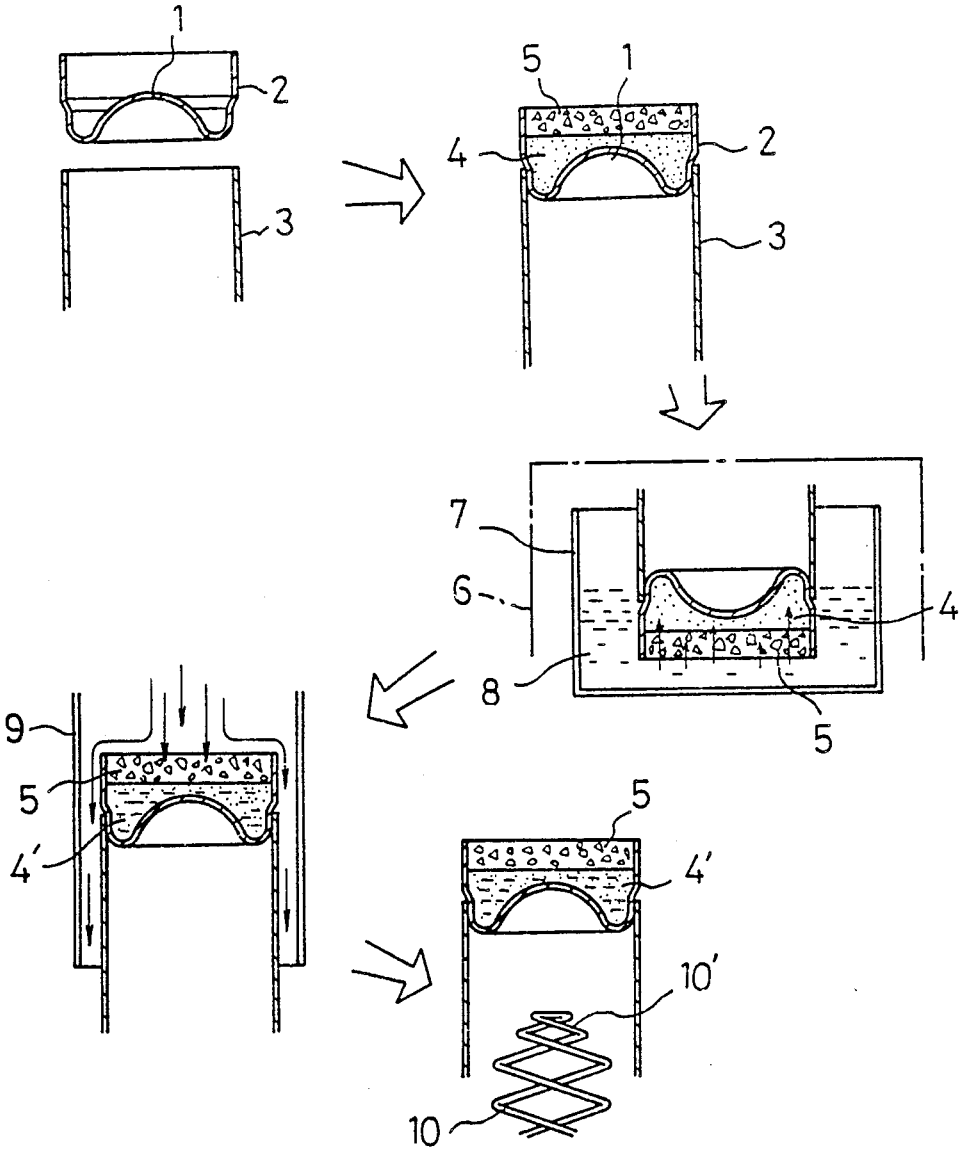
FIG. 1 illustrates the process of manufacturing the cathode according to the present invention.

As shown in FIG. 1, a cup 2 as of molydenum provided with a convex portion 1 at the bottom thereof is unitigingly secured to a sleeve 3 by an ordinary spot welding, and then, a reduction agent containing tungsten powder having a purity of over 99% in the amount of 80–100 wt%, magnesium powder in the amount of 0–20 wt%, and silicon powder in the amount of 0–20 wt%, and having an average particle size of 1–10$\mu$ m is filled into the cup 2 in the amount of 60% of the total capacity of the cup. Then a porous metal layer 5 made of sintered tungsten having a porosity of 30% is put to the top of the cup 2 to seal it by welding, thereby forming an electrode.

Second step

An impregnation compound 8 is put into an impregnation tank 7 within vacuum furnace 6, and then the compound is melted, the impregnation compound 8 being the item A selected from the above table.

Upon melting of the impregnation compound 8, the electrode obtained in the first step is put into the impregnation tank 7 in an inversed position, and then, the impregnation compound 8 is impregnated in such a manner that the compound 8 should pass through the porous metal layer 5 and should contact with the reduction agent 4 filled within the cup 2.

Through this process, the reduction agent 4 and the impregantion compound 8 are reacted with each other, with the result that the free barium elements 4' are reduced in a state accommodated within the cup 2, while the residue impregnation compound 7 in a large number of pores of the porous metal layer 5 causes the lowering of the porosity.

Third step

The electrode which has undergone the impregnation is put over a gas nozzle 9, and an inert gas is injected to open up the closed pores.

In this process, the inert gas is injected either through the gas nozzle 9 with a proper pressure, or injected in such a manner that first the porous metal layer 5 is made to be open to the gas nozzle 9 under a vaccum, and then, the vacuum is released so as for the inert gas to be injected into the porous metal layer regard to the atmospheric pressure, and so as for the closed pores to be opened.

When the inert gas is being injected into the porous metal layer 5 in the above process, the impregnation compound filled in the pores removing from the pores having large diameters.

The re-opening ratio of the pores with regard to the inert gas depends on various factors such as the space within the cup, the gas introduction speed, the intensity of the vacuum, the viscosity of the impregnation compound, the porosity and pore distribution of the porous metal layer, and the occupation area of the impregnation compound within the porous metal layer.

The electrode which has undergone the above described process will show cases in which the residue impregnation compound adhered on the surface of the porous metal layer, the cup or the sleeve is solidified. This solidified impregnation compound has to be removed by the ordinary short blasting process using alumina.

Figure 2:
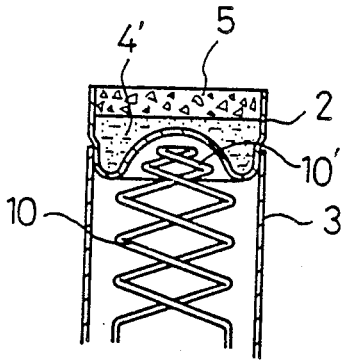
FIG. 2 illustrates the structure of the cathode according to the present invention.

The electrode manufactured on the basis of the above described process forms a cathode for electron tube as a whole by inserting the heating member 10 toward the sleeve 3 as shown in FIG. 2.

The heating member 10 has an upper-most head portion 10' which is disposed within the convex portion 1 of the cup 2, and includes filament.

Accordingly, the thermal conduction is carried out from the heating member 10 through the convex portion of the cup 2 to the interior of the cup 2 in a uniform manner, thereby considerably shortening the time required for the initial activation, with the result that the cathode according to the present invention comes to have a quick start-up characteristics.

If required, an insulative layer can be dopsited on the bottom of the convex portion 1 of the cup 2 and the uppermost portion of the heating member 10, this insulative layer being for preventing any electrical contact between the cup and the filament of the heating member.

Figure 4A:
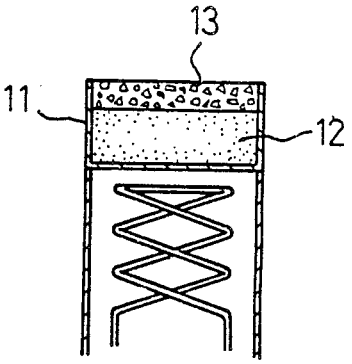
FIG. 4A illustrates a dispenser type cathode structure.
Figure 4:
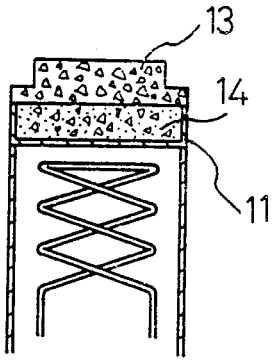
FIG. 4B illustrates a space division type cathode structure.
Figure 3:
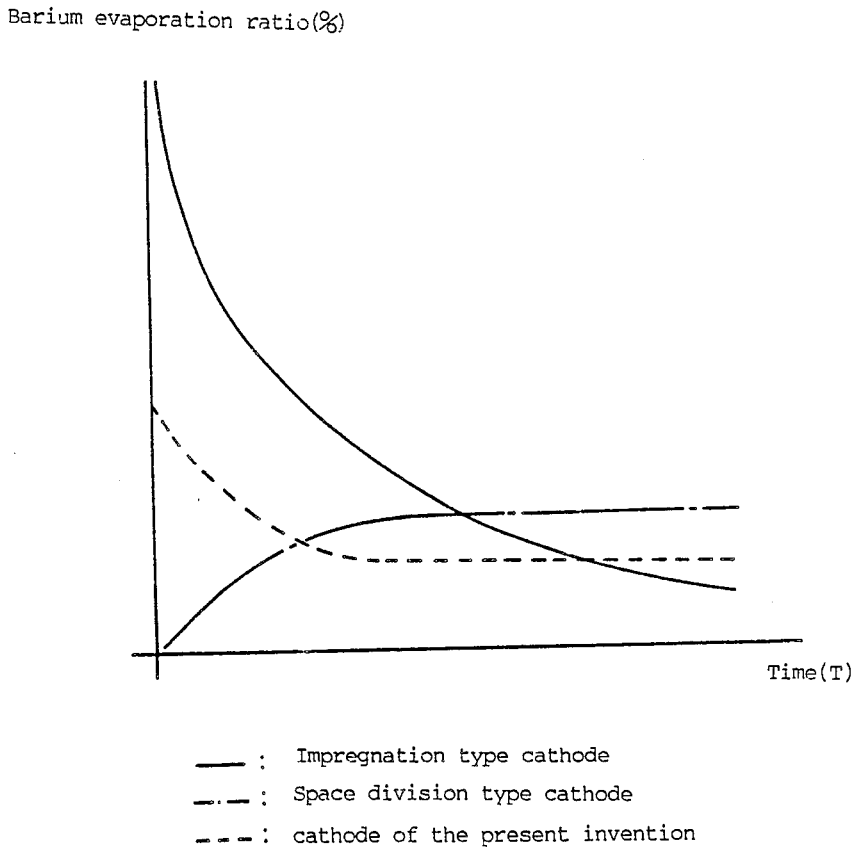
FIG. 3 is a graphical illustration showing the improvements of the performance of the cathode according to the present invention.

A comparison of the performances of the cathode of the present invention and the conventional dispenser type or space division type cathodes as shown in FIG. 4A and 4B is graphically illustrated in FIG. 3.

According to this graphical illustration, the impregnation type cathode is very high in its evaporation ratio during the initial stage, and thereafter, the ratio is steeply lowered, thus its life expectancy being shortest. The space division type has a long life expectancy, but instead, the barium evaporation ratio during the initial stage is extremely low, and therefore, it has a problem in its practicality, whereas the cathode according to the present invention shows a relatively high barium evaporation ratio during the initial stage, and stablishes a uniform evaporation ratio within a short period of time, with the result that its life expectancy is extended, and that it holds all the required features as a cathode for electron tube.

According to the present invention as described above, the reduction agent and the impregnation compound are reacted within the cup to produce free barium atoms in concentrated state. The pores blocked during the impregnation are re-opened by means of an inert gas during the final process, and the heating member provides a uniform conduction of heat through the convex portion provided at the bottom of the cup, with the result that the disadvantages of the conventional cathodes such as the speedy evaporation of barium during the initial stage, and the degrading of the performance and the shortening of the life expectancy due to the reaction by-product produced in the porous metal layer can be overcome, and that a quick start-up characteristics is obtained due to the speedy diffusion of the barium.

Further, according to the present invention, free barium atoms are produced during the impregnation process, and stay in the interior of the cup, and therefore, there is obtained the advantage that the time required for carrying out the thermal aging after the manufacturing can be greatly shortened.

What is claimed is:

1. A method of manufacturing a cathode for an electron tube, comprising the steps of:

filling a reducing agent into a metal cup having an open top such that 10 to 100% of the volume of said cup is filled with said reducing agent;

sealing said cup at the top with a layer of porous metal to form thereby an electrode;

melting an impregnation compound;

passing the impregnation compound through pores of said porous metal layer into said cup to cause thereby said impregnation compound and reducing agent to react with each other; and injecting an inert gas through the pores of said porous metal layer to remove compound in said pores.

2. The method according to claim 1, wherein said reduction agent contains 80–100 wt% tungsten powder having a purity of over 99%, 0–20 wt% silicon powder, and 0–20 wt% magnesium powder.

3. The method according to claim 1, wherein said porous metal layer is made up of tungsten or tungsten containing at least one of the following elements: nickel, steel and cobalt, in the amount of 0.05–10 wt%.

4. A method according to claim 1, wherein said cup is made of molybdenum.

5. A method according to claim 1, wherein the porosity of said metal layer is 10 to 40%.

6. A method according to claim 1, comprising melting said impregnation compound and passing same through the pores in said porous metal layer in an impregnation tank within a vaccum furnace.

* * * * *